United States Patent [19]

Wahrendorf et al.

[11] 4,193,718

[45] Mar. 18, 1980

[54] EARTH RETAINING WALL OF VERTICALLY STACKED CHEVRON SHAPED CONCRETE BLOCKS

[75] Inventors: York A. Wahrendorf, Brunswick; Herbert K. Frenzel, Bremen; Adolf K. Ambrosch, Weiterstadt, all of Fed. Rep. of Germany; Knud A. Rasmussen, Roskilde, Denmark; Horst Seibert, Giessen-Wieseck; Horst J. Dieckmann, Twistringen, both of Fed. Rep. of Germany

[73] Assignee: SF-Vollverbundstein-Kooperation GmbH, Bremen, Fed. Rep. of Germany

[21] Appl. No.: 923,284

[22] Filed: Jul. 10, 1978

[30] Foreign Application Priority Data

Jul. 11, 1977 [DE] Fed. Rep. of Germany ..... 2731228

[51] Int. Cl.[2] ..... E02D 29/02

[52] U.S. Cl. ..... 405/286; 405/262

[58] Field of Search ..... 405/284, 286, 258, 259, 405/273, 285, 287, 15, 16, 17, 29, 33, 258, 262

[56] References Cited

U.S. PATENT DOCUMENTS

| | | | |
|---|---|---|---|
| 2,882,689 | 4/1959 | Huch et al. | 405/284 |
| 3,210,944 | 10/1965 | Svee | 405/33 |
| 3,686,873 | 8/1972 | Vidal | 405/262 |

FOREIGN PATENT DOCUMENTS

| | | | |
|---|---|---|---|
| 966135 | 3/1950 | France | 405/262 |

*Primary Examiner*—Alexander Grosz

*Attorney, Agent, or Firm*—Sughrue, Rothwell, Mion, Zinn and Macpeak

[57] ABSTRACT

An earth retaining wall formed by stacked, alternately staggered rows of spaced, nesting, chevron-shaped concrete blocks. Adjacent blocks in some rows are coupled together by connecting tubes extending into holes through the blocks, and elongated anchoring devices are connected to the tubes and extend horizontally into the earth. Alternatively, the anchoring devices may be concrete extensions integrally moulded with the blocks.

2 Claims, 9 Drawing Figures

EARTH RETAINING WALL OF VERTICALLY STACKED CHEVRON SHAPED CONCRETE BLOCKS

BACKGROUND OF THE INVENTION

The invention relates to a retaining wall for defining earth banks, earth walls and other earth slopes, consisting of individual moulded blocks of concrete or the like arranged in rows or courses one above the other.

The retaining walls concerned here consist of moulded concrete blocks which are to lie one upon the other predominantly without mortar connection, that is loosely. The purpose of the invention is to form moulded blocks suitable for this purpose so that on the one hand they are easy to produce, namely with substantially conventional concrete block machines and concrete moulds of ordinary basic assembly, and on the other hand render possible easy laying for the formation of retaining walls, namely up to a certain height without anchorage of the individual moulded blocks.

SUMMARY OF THE INVENTION

To solve this problem the retaining wall according to the invention is formed from moulded blocks the upper side of which is of protruding roof-shaped configuration and the under side of which is of correspondingly roof-shaped retracted or concave configuration, the bearing surfaces thus formed on the under side of the moulded blocks being narrower than the two corresponding bearing surfaces of the upper side of the moulded blocks.

Such moulded blocks can be produced in a manner known in principle very simply, namely with an upright position within a concrete mould. Moreover, due to the configuration of the moulded blocks an especially favourable mutual shape-engaging anchorage results. On the free outer side and on the side facing the earth, step-like shoulders are produced which result in a favourable external image and good anchorage with the earth.

In order that even very high retaining walls may be formed along the lines of the invention, using the moulded blocks as explained, a further proposal of the invention consists in that at least a number of moulded blocks is provided with elongated transverse ties which can be formed and arranged in various ways. Elongated earth ties consisting of flat sections or with a prefabricated concrete part as an anchoring block are attached to the moulded blocks through a special, easily assemblable connecting construction. Alternatively, special anchoring moulded blocks can be installed in the retaining wall and consist of concrete or the like with a head piece installed in the retaining wall, after the manner and form of a moulded block, and an anchoring end integrally adjoining the head piece. This latter embodiment of the anchorage has the advantage of low depth of anchorage.

In the case of retaining walls arranged on both sides of earth walls, banks etc., these walls are connected with one another at appropriate construction heights by transverse connection ties. These can be attached to the moulded blocks, and tightened for example by a turnbuckle.

DETAILED DESCRIPTION OF THE PREFERRED EMBODIMENTS

Figure 1:
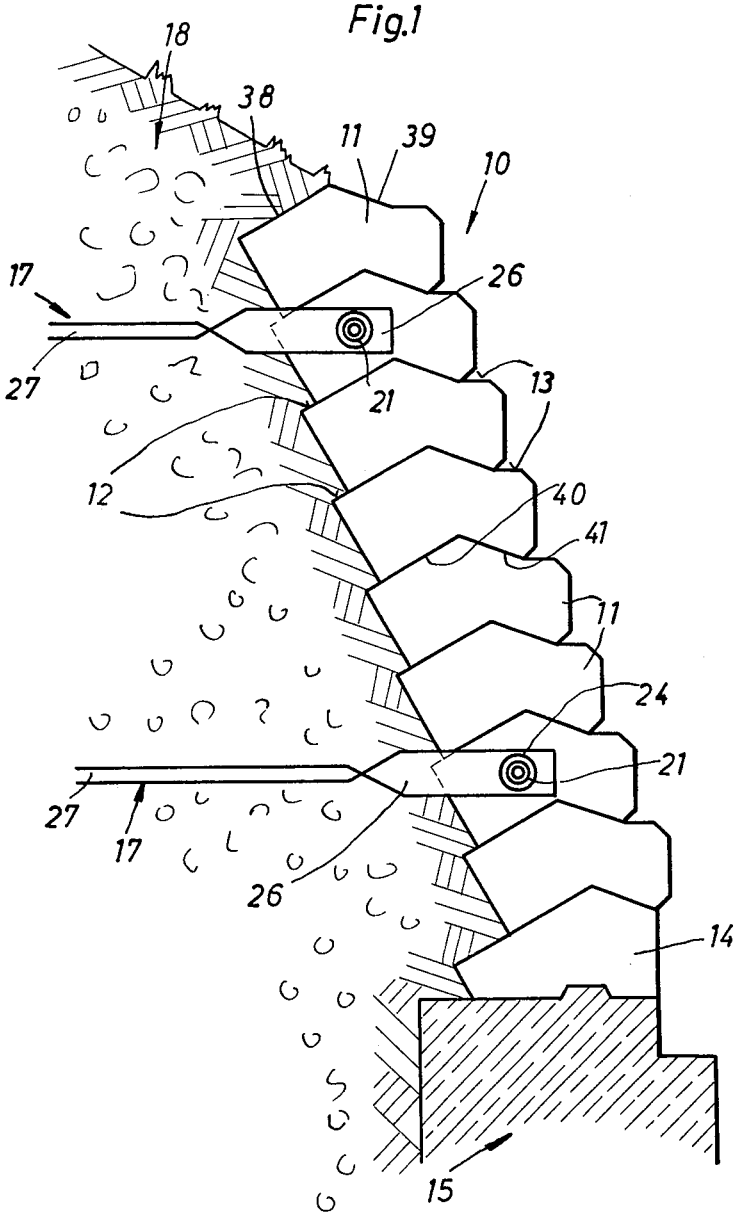
FIG. 1 shows a retaining wall of individual moulded blocks with earth ties, in diagrammatic lateral elevation.
Figure 2:
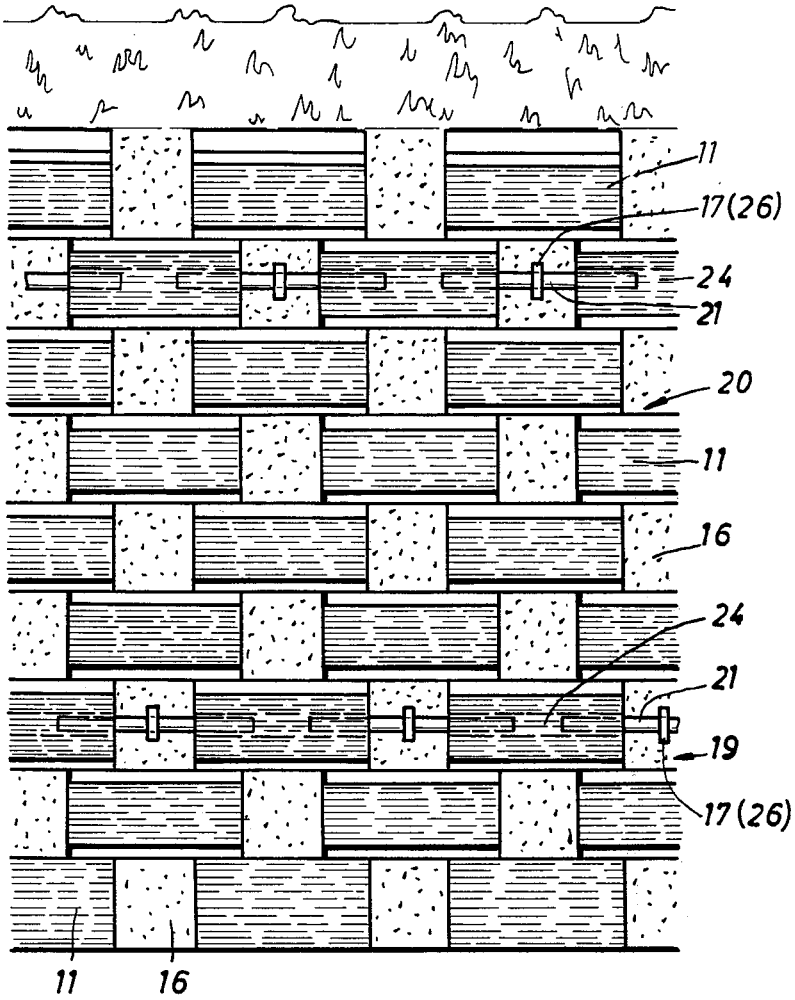
FIG. 2 shows a front view of the retaining wall according to FIG. 1.

In the drawings, the retaining wall 10 as illustrated in FIGS. 1 and 2 consists of individual moulded blocks 11 arranged one above the other, which engage with one another in shape-locking manner due to their roof-shaped angular formation. Due to the roof-shaped cross-section of the moulded blocks 11, bearing surfaces 38, 39 directed at an angle to one another are produced on the upper side and oppositely, that is below, there are produced bearing surfaces 40, 41 correspondingly arranged at angle. The upper bearing surface 39 facing away from the soil is again angled and thus forms a protruding shoulder 13. A similarly step-shaped shoulder 12 is formed on the inner side, that is facing the earth 18. The sides facing the earth and the sides facing outwards are mutually convergent. At the foot of the retaining wall 10 a special base block 14 is arranged which rests on a foundation 15 of cast-in-place concrete. Alternatively, the base block can also be formed as an ordinary moulded block 11 and to form the inclination of the retaining wall it can be pressed into the still unset soft concrete of the foundation 15.

The moulded blocks 11 are laid in individual horizontal courses as shown in FIG. 2 with spacing from one another and in a staggered arrangement. The interspaces 16 thus formed can receive decorative plants.

The retaining wall 10 is provided with transverse ties, especially earth ties, of various formations. In FIGS. 1 and 2 an earth tie 17 is connected with the retaining wall 10 and the moulded blocks 11 of a course 19 or 20. Adjacent moulded blocks 11 of such a course are attached to one another by connection pieces extending in the direction of the course. These connection pieces are formed as connection tubes 21. Accordingly, they consist of a preferably galvanised, seamless tube piece. A connection tube 21 passes with its ends 22, 23 into holes 24 in moulded blocks 11 extending continuously through the blocks in the direction of the courses, that is from side face to side face. The ends 22, 23 of the tube 21 pass with an adequate anchoring depth into these holes 24. If necessary fixed stops 25 can be arranged on the tube to determine the depth of entry.

Figure 3:
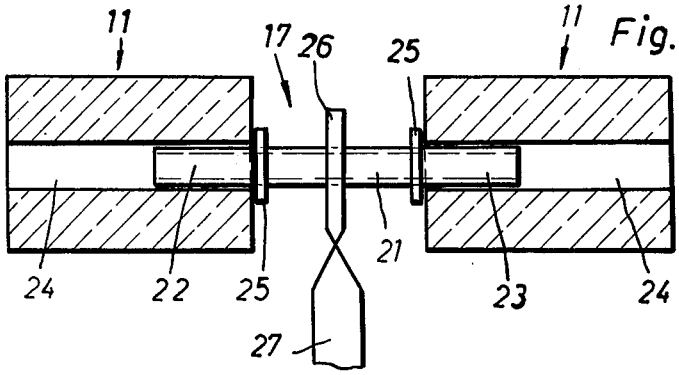
FIG. 3 shows a horizontal section through two adjacent moulded blocks with a part of an earth tie, on an enlarged scale.

Between the adjacent moulded blocks 11 an earth tie 17 is mounted on the connection tube 21. In FIGS. 1 to 3 the earth tie 17 is seated with a mounting end 26 directly on the connection tube 21. Here the earth tie 17 is formed as a flat bar and the mounting end 26 is twisted 90° in comparison with a horizontally disposed anchorage section into an upright position.

In FIGS. 4 to 7 the moulded blocks 11 are likewise attached together by connection tubes 21. Here, however, the earth ties 17 are attached indirectly to this connection tube through an intermediate structure 28. This consists of a number of bars or tube ends which are fitted into one another. In detail, a carrier tube 29 is allocated to each earth tie 17 which is connected with this tube 29. Adjacent carrier tubes 29 are connected with one another by an intermediate tube 30 fitted into the mutually facing ends of the carrier tube 29. A short distance remains between these ends of the carrier tubes 29. Here a connection strap 31, in the form of a flat bar, is mounted on the intermediate tube 30. The strap 31 is seated on the connection tube 21 with its remote end after the manner of the earth tie 17 according to FIGS. 1 to 3. The intermediate structure 28 lying predominantly outside the region of the retaining wall, namely in the earth 18, can also be of a different configuration.

Figure 4:
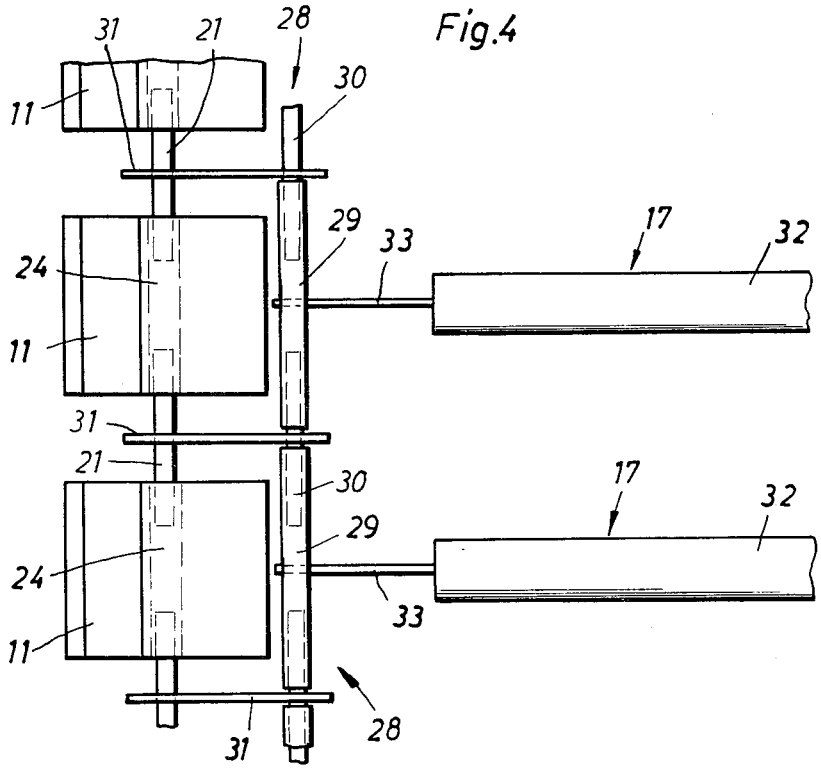
FIG. 4 shows a detail of a retaining wall in plan view, with another form of embodiment of the anchorage.
Figure 5:
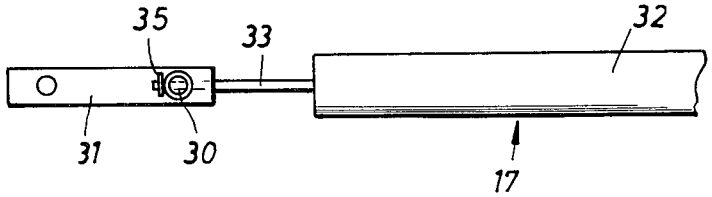
FIG. 5 shows a detail of the embodiment according to FIG. 4 in lateral elevation.
Figure 6:
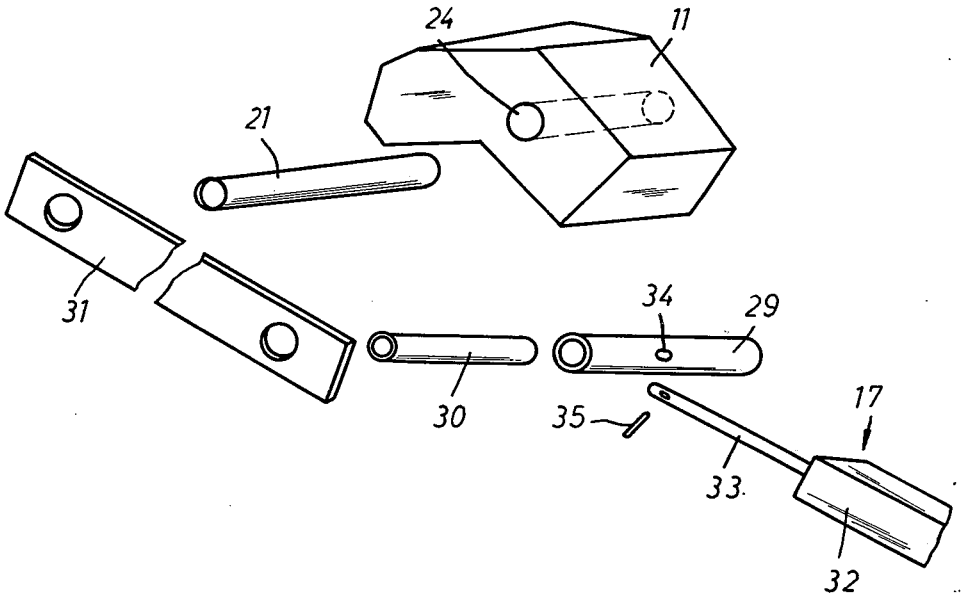
FIG. 6 shows the anchorage of the retaining wall according to FIGS. 4 and 5 as an exploded diagram.

In FIGS. 4 to 7 the earth ties 17 consist of an elongated prefabricated concrete part 32 embedded in the soil, which is connected with the tube 21 or the intermediate structure 28 by means of a flexible anchor piece 33, for example a round galvanized section. The anchor piece 33 adjoins the transversely directed carrier tube 29, and as shown in FIGS. 4 to 6 the end of the anchor piece 33 is conducted through a radial bore 34 and made fast on the opposite side by an anchoring pin 35. This connection here takes place approximately centrally in relation to the associated moulded block 11.

Figure 7:
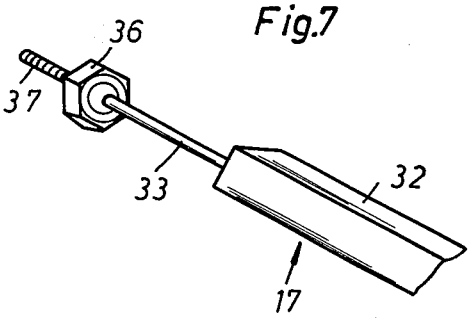
FIG. 7 shows a detail of FIG. 6 in modified embodiment, in perspective representation.

According to the embodiment in FIG. 7 provision is made for tightening the laid earth tie. This is possible by a turnbuckle arranged in the region of the earth tie 17 or, as shown by FIG. 7, by a tightening nut 36 which is seated on the end of the anchor piece 33 which is conducted through the bore 34 and provided with a threading 37. The anchor piece is drawn through the bore 34, tightening the earth tie 17 by tightening the nut 36.

Figure 8:
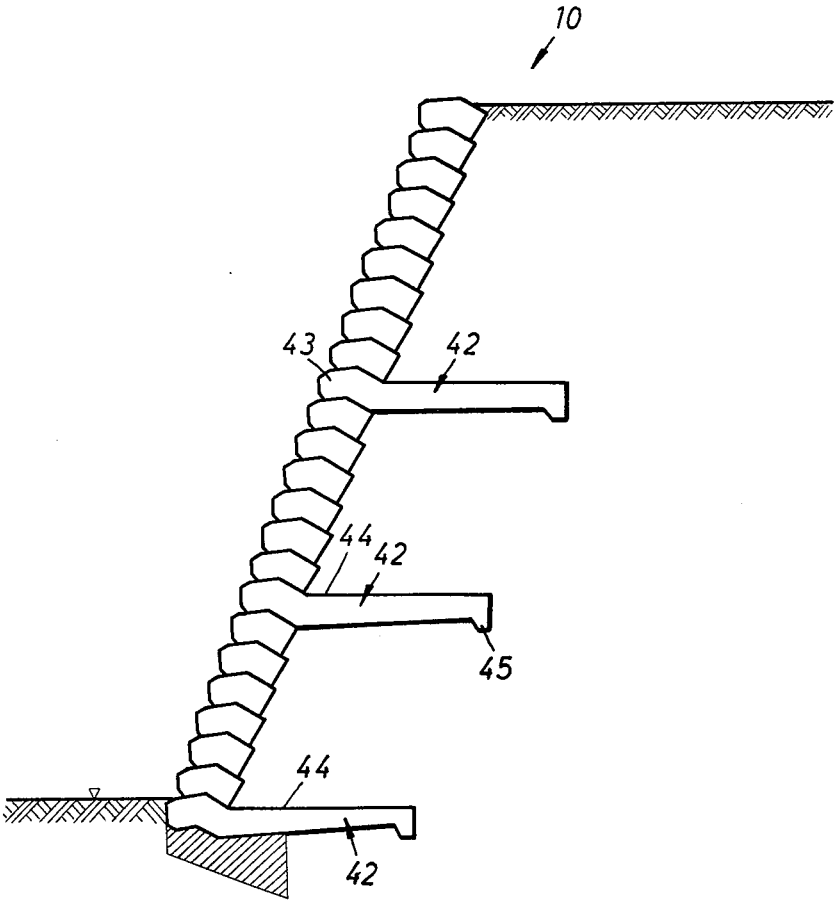
FIG. 8 shows a retaining wall of individual moulded blocks with built-in integral anchoring moulded blocks, in lateral elevation.

In FIG. 8 a retaining wall 10 is shown in which, in place of the above-described earth ties 17, special moulded anchoring blocks 42 are used. These one-piece mouldings of concrete are provided with a head piece 43 which corresponds to the configuration and contours of a moulded block 11. On the side of the earth 18 an anchoring end 44 in the form of a concrete beam adjoins and is provided at its free end with a thickening 45 which effects an additional anchorage in the earth 18. The anchoring blocks 42 can be produced very simply in an appropriate concrete mould. Laying is likewise simple because no special coupling elements are required. The connection of the blocks 42 to the retaining wall 10 results from their installation in the wall.

The course accommodating the moulded anchoring blocks 42 are expediently formed without interspaces 16, in which place the narrower moulded anchoring blocks 42 lie with their head piece 43 without interval between the adjacent moulded blocks 11. Head pieces 43 and the adjacent moulded blocks 11 are expediently connected with one another by a layer of mortar or adhesive.

Figure 9:
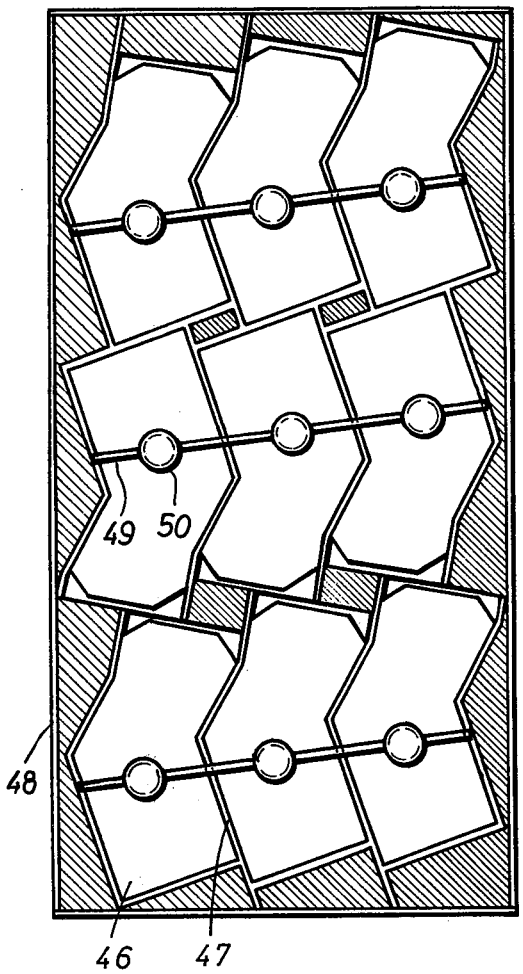
FIG. 9 shows a concrete mould for the production of moulded blocks, in plan view.

The blocks 11 may be mass produced in a conventional concrete block machine (not shown). FIG. 9 shows a concrete mould suitable for this purpose, in plan view. In this mould individual mould pockets 46 are formed each for the reception of a moulded block 11. The mould pockets 46 are separated from one another in the usual way be webs 47. The configuration of the moulded blocks 11 along the lines of the invention renders possible a mutually inserted arrangement of the mould pockets 46 within an outer frame 48 in such a way that considerable numbers can be manufactured in each working cycle with relatively small concrete moulds. Since the smooth-faced moulded blocks 11 are arranged with the end surfaces, which face one another in the laid condition, directed upwards and downwards, removal from the moulds is also possible in the conventional manner.

In the example illustrated, transverse bearers 49 are arranged on the webs 47 of the concrete mould, and round core pieces 50 are secured on these bearers. These extend into the mould pockets 46 and serve to shape the holes 24 in the moulded blocks 11.

What is claimed is:

1. A retaining wall for the limitation and containment of sloping earth banks and the like including a plurality of individual moulded blocks of concrete or the like arranged in horizontal courses vertically stacked one above the other, characterized by:

(a) each block being generally chevron-shaped with a convex, angled upper surface and a concave, correspondingly angled lower surface, with the upper surfaces of the blocks in the intermediate courses being matingly received in the lower surfaces of the blocks in a course immediately above, (b) the opposite sides of each block facing towards and away from the earth bank being oriented in downwardly converging planes so that the upper surface of each block is wider than its lower surface, (c) the wider upper surfaces of the blocks in each intermediate course defining upwardly facing shoulders that project outwardly both towards and away from the earth bank from the edges of the narrower lower surfaces of the blocks in the course immediately above, and (d) the shoulders that project outwardly away from the earth bank being defined by generally horizontal surfaces disposed at an inclined angle to the adjacent upper surfaces of the blocks, to thereby provide outwardly extending steps.

2. A retaining wall as defined in claim 1, wherein a plurality of the blocks include integral earth anchoring members moulded with the blocks, each anchoring member comprising an elongated arm joined at one end to the side of a block facing towards the earth bank, extending generally horizontally into the earth bank, and having an anchoring enlargement on its other end.

* * * * *